US005160292A

United States Patent [19]

Parker

[11] Patent Number: 5,160,292

[45] Date of Patent: Nov. 3, 1992

[54] VACUUM SYSTEM FOR MULTIPLE WORK AREAS

[76] Inventor: Kenneth W. Parker, 5595 Calico Rd., West Palm Beach, Fla. 33415

[21] Appl. No.: 648,548

[22] Filed: Jan. 30, 1991

[51] Int. Cl.[5] ..... B08B 15/00

[52] U.S. Cl. ..... 454/49; 251/129.2

[58] Field of Search ..... 98/115.1, 115.2, 115.3, 98/115.4; 251/129.2

[56] References Cited

U.S. PATENT DOCUMENTS

| | | | |
|---|---|---|---|
| 2,522,249 | 9/1950 | Baker | 251/129.2 X |
| 2,736,151 | 1/1956 | McKenzie | 251/129.2 X |
| 2,976,556 | 3/1961 | Reiterer | 15/301 |
| 3,048,875 | 8/1962 | Bottinelli et al. | 15/301 |
| 3,050,767 | 8/1962 | Rankin | 15/314 |
| 3,471,890 | 10/1969 | Ramo | 15/301 |
| 3,616,745 | 11/1971 | Russell, Sr. | 98/115.1 |
| 3,628,213 | 12/1971 | Ramo | 15/301 |
| 4,049,321 | 9/1977 | Bunting | 15/301 X |
| 4,719,662 | 1/1988 | Horak et al. | 15/301 |

FOREIGN PATENT DOCUMENTS

| | | | |
|---|---|---|---|
| 22435 | 1/1981 | European Pat. Off. | 98/115.1 |

*Primary Examiner*—Harold Joyce

*Attorney, Agent, or Firm*—Quarles & Brady

[57] ABSTRACT

A vacuum system for multiple work areas preferably includes a vacuum source connected to a plurality of vacuum conduits leading to the work areas. Each of the conduits has a vacuum opening in the vicinity of the associated work area, through which gases and other airborne contaminants generated by equipment in the work area are drawn into the vacuum conduit, and thereby removed from the work area. Valve members are associated with each of the vacuum conduits, and are positionable in the conduits so as to prevent air flow through the conduits. Structure is provided to open the valve whenever the associated equipment is in the contaminant-generating mode of operation, and to close the valve whenever the equipment is not in this mode of operation.

4 Claims, 5 Drawing Sheets

VACUUM SYSTEM FOR MULTIPLE WORK AREAS

BACKGROUND OF THE INVENTION

1. Field of the Invention

The present invention relates generally to vacuum systems, and more particularly to vacuum systems associated with multiple work areas.

2. Description of the Prior Art

Many industries use equipment which in operation generates atmospheric contaminants, which might be gases or airborne particles. These gases and particles are sometimes a health hazard to the operator, as well as to other employees and the environment in general. This problem is especially acute in industrial operations such as wood-working or painting, where dust and gases that are harmful if inhaled are generated in close proximity to the worker. Additionally, particulates can eventually build up and damage equipment in the work area, and often require regular cleaning of the work area. Government regulations in many instances now strictly regulate the amount of such gases and particles which can be present in or emitted from the work area.

Vacuum systems have been installed to withdraw airborne contaminants generated in such work areas. A single vacuum source is usually provided. A manifold usually communicates between the vacuum source and a number of vacuum conduits, the conduits extending to individual work areas. Vacuum openings in the vacuum conduits are provided at the work areas to permit the withdrawal of air from the work area. The gases and particles in the air are thereby removed, and subsequent filtration or other cleansing operations can be employed downstream to permit subsequent disposal of the contaminants. A hood can be provided in association with each vacuum conduit and vacuum opening to reduce the amount of particles and gases that escape from the work area.

A large vacuum pump, with corresponding operating expense, is required to provide adequate vacuum to a number of work areas. Equipment in these areas, however, does not always operate continuously, but sometimes infrequently or intermittently. Vacuum flow from such work areas is wasted whenever the equipment is not in operation. Energy is lost by the needless withdrawal of air from these work areas on a continuous basis. Also, the size of the vacuum pump that is necessary for servicing these work areas is unnecessarily increased by the unnecessary generation of vacuum.

Manual shutters have been installed into the vacuum conduits of such systems to reduce the energy consumption caused by air being withdrawn from work areas having idle equipment. The shutters are often thin metal or plastic plates that are inserted transversely across the vacuum conduit when the respective equipment serviced by that conduit is not in use or is not in a contaminant-generating mode of operation. The air flow through the respective vacuum conduit is blocked, which advantageously causes a greater vacuum pull in the conduits where equipment is in use and vacuum is required. Many operators, however, forget or refuse to close the shutters as necessary, and leave the shutters open at all times. This causes a substantial loss of vacuum pull through those conduits where equipment is in use. The manual shutters are usually made of metal, and are known to sometimes bend or rust. Also, significant vibration noise can be generated by the loosely-fitted shutters.

SUMMARY OF THE INVENTION

It is an object of the invention to increase the efficiency of vacuum systems for multiple work areas.

It is another object of the invention to reduce the emissions of gas and particulate contaminants from work areas.

It is yet another object of the invention to provide a vacuum system for multiple work areas which will withstand the rigors of the industrial environment.

These and other objects are accomplished by a vacuum system for multiple work areas in which a vacuum source is connected to several vacuum conduits. Each of the vacuum conduits extends to an associated work area, and has at least one vacuum opening so as to permit air flow from the work area and through the vacuum conduit. This will provide for the removal of gases or airborne contaminants from the work area. A valve member is preferably associated with each of the vacuum conduits and is adapted to alternately permit or prevent the flow of air through the conduit. A valve-actuator is adapted to close the valve whenever equipment associated with the respective work area is not operating or is not in a contaminant-generating mode of operation, and to open the valve whenever the equipment is operating so as to provide vacuum to that work area and removal of airborne contaminants generated by the equipment.

The manner by which the valve actuator is caused to open or close the valve can be varied. In the preferred embodiment, the valve actuator will be a solenoid or electric motor which receives either operating current or control current whenever the respective piece of equipment is in a contaminant-generating mode of operation. Most preferably, the valve actuator is electrically driven and is wired through a single switch which controls power both to the equipment and to the valve actuator, such that when the equipment is "on" the valve actuator will be automatically energized to open the valve and to permit the withdrawal of air from the respective work area. The valve actuator will thereby also be automatically deactivated whenever the equipment is turned off, to provide for the return of the valve to the closed position.

The valve can be adapted for installation within the vacuum conduits. Alternatively, the valve can be conveniently provided in a separate valve housing which replaces a portion of existing vacuum conduit. The valve housing is adapted for direct connection to the vacuum conduit.

The type of valve that is utilized can be selected from several alternative designs, including butterfly-type valves and gate valves. In a preferred embodiment, the valve includes a gate-valve member that is transversely slidable through a side opening in the valve housing or vacuum conduit. The valve member can be connected to pivot arms, which arms are pivotally connected to the valve housing or vacuum conduit. Operation of the valve actuator will cause the pivot arms to rotate about the pivotal mounting, to respectively move the valve member into or out of the air flow path within the valve housing or vacuum conduit.

BRIEF DESCRIPTION OF THE DRAWINGS

These are shown in the drawings embodiments which are presently preferred it being understood, however, that the invention is not limited to the precise arrangements and instrumentalities shown wherein.

DETAILED DESCRIPTION OF THE PREFERRED EMBODIMENTS

Figure 1:
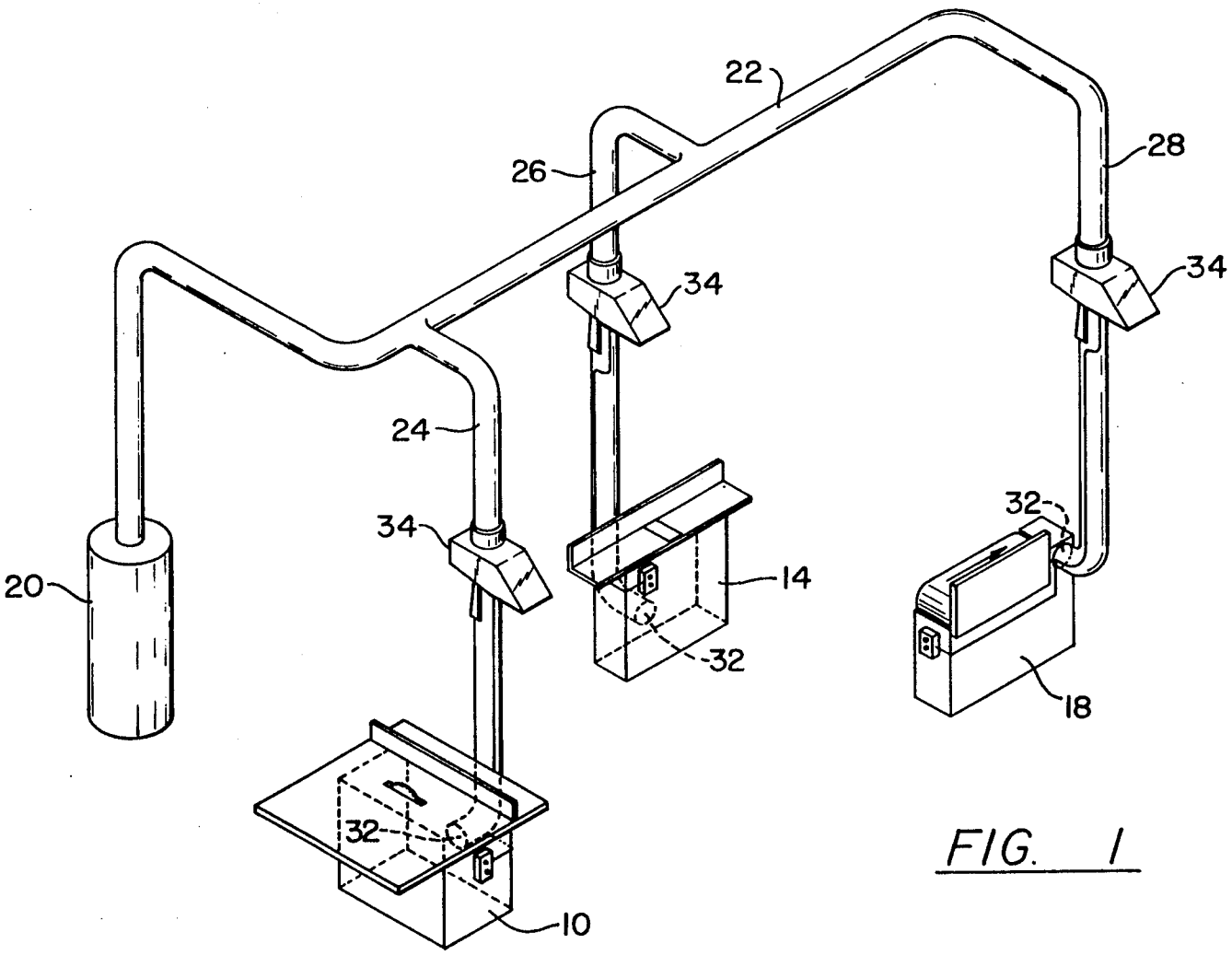
FIG. 1 is a perspective view of a vacuum system according to the invention.

There is shown in the drawings a preferred embodiment of a vacuum system for multiple work areas according to the invention. The invention is useful in work areas having many different types of pieces of equipment and performing many different contaminant-generating operations, but for illustration purpose a wood-working shop is depicted. The woodworking shop of the illustrated embodiment includes a table saw 10, a jointer 14, and a large belt sander 18. A vacuum source 20, which can be of any suitable design, is adapted to draw air through a vacuum manifold 22. A series of vacuum conduits 24, 26, and 28 connect to the vacuum manifold 22 and extend to a position that is preferably immediately adjacent to each piece of equipment which is capable of generating airborne gas or particulate contaminants. Each vacuum conduit opens at a vacuum opening 32 to permit the withdrawal of air from the respective work area. Hoods 34 can be provided to assist in the collection of dust, gas, or other atmospheric contaminants, and to prevent injury from the operation of a valve device according to the invention.

Each of the vacuum conduits preferably has associated therewith a valve adapted to alternatively permit or prevent the flow of air through the vacuum conduit. The valve includes a valve member moveable into and out of the flow path of air to respectively prevent or permit the flow of air through the valve and vacuum conduit. The present invention contemplates an assembly in which the valve member is automatically driven to the "closed" position whenever the equipment associated with the respective work area is "off", and is driven to the "open" position whenever the equipment is "on" or otherwise is in a contaminant-generating mode of operation.

A valve actuator is adapted to selectively drive the valve member to the closed or open positions. The valve actuator is operatively connected to a contaminant-generating piece of equipment in the work area of the associated vacuum conduit, and is so connected such that operation of the equipment will automatically cause the valve actuator to move the valve member to the "open" position. Vacuum will thereby be applied through the vacuum opening to the work area during operation of the respective piece of equipment, when airborne contaminants are being generated. A cessation of operation of the equipment will automatically result in movement of the valve member to the "closed" position, preventing air flow through the respective vacuum conduit. The work area will thereby be removed from the vacuum supply whenever the respective piece of equipment is not on, and the needless waste of energy will be prevented.

In a most preferred embodiment, a switch to provide power to the contaminant-generating equipment is also electrically connected to the valve actuator, and the supply of electrical power to the equipment through the switch will thereby also supply controlling electrical power to the valve actuator. The valve actuator will thereby move the valve member to the "open" position whenever the equipment is turned on. Opening the switch to shut off power to the equipment will remove power to the valve actuator, which will result in the return of the valve member to the "closed" position. It will be the usual case that the valve actuator will be driven by operation of the equipment, however, it is also possible to provide constructions in which the valve actuator and valve member are in the "open" position only during particular cycles or modes of operation of the equipment, for example, during a painting operation, while in the "closed" position during an operation or equipment cycle which does not generate airborne contaminants.

A preferred valve assembly according to the invention is shown in FIGS. 2–5. The valve assembly can conveniently be provided in a valve housing 40. The valve housing 40 allows the installation of the valve as a pre-assembled unit. A section of the vacuum conduit can be removed, and the valve assembly is installed in its place. Alternatively, a valve according to the invention can be installed within an existing vacuum conduit section.

In a preferred valve embodiment, a valve member 44 is fixed to support arms 46, 48, which are pivotally mounted to the valve housing 40 or to the vacuum conduit within which the valve is installed. The pivotal mounting can be accomplished through several suitable means, such as bolts 50. The support arms 46, 48 are connected to a valve actuator such as the solenoid 56. Mechanical structures can be included which will provide leverage to facilitate movement of the valve member 44 by the solenoid 56. Lever members 52, 54 can be connected to a plunger 60 of the solenoid 56 by a brace 58. The lever member 52, 54 can be pivotally connected to the housing 40 through suitable means such as the shafts 59. The lever members 52, 54 can be connected to the pivot arms 46, 48 by connecting arms 63, 65.

A slot 62 is provided in the valve housing 40 to permit insertion of the valve member 44. Activation of the solenoid 56, as through a control line, will cause the retraction of the plunger 60 and the pivotal movement of the support arms 46, 48 from the position of FIG. 4 to the position of FIG. 2. The valve member 44 will be caused to pivot about the bolts 50 and out of the slot 62. The mechanical connection between the pivot arms 46, 48 should be dimensioned to provide a proper amount of throw of the valve member 44 for a given movement of the plunger 60, so as to fully open the valve. This will permit air flow through the valve housing 40 and the application of vacuum to the respective work area. The valve member 44 and slot 62 can be curved so as to be substantially coincident with the arc of rotation when pivoted between the "closed" and "open" positions. An end stop portion 45 can be provided to stop the motion of the valve member 44 into the housing 40, and to prevent damage to the housing 40.

Figure 2:
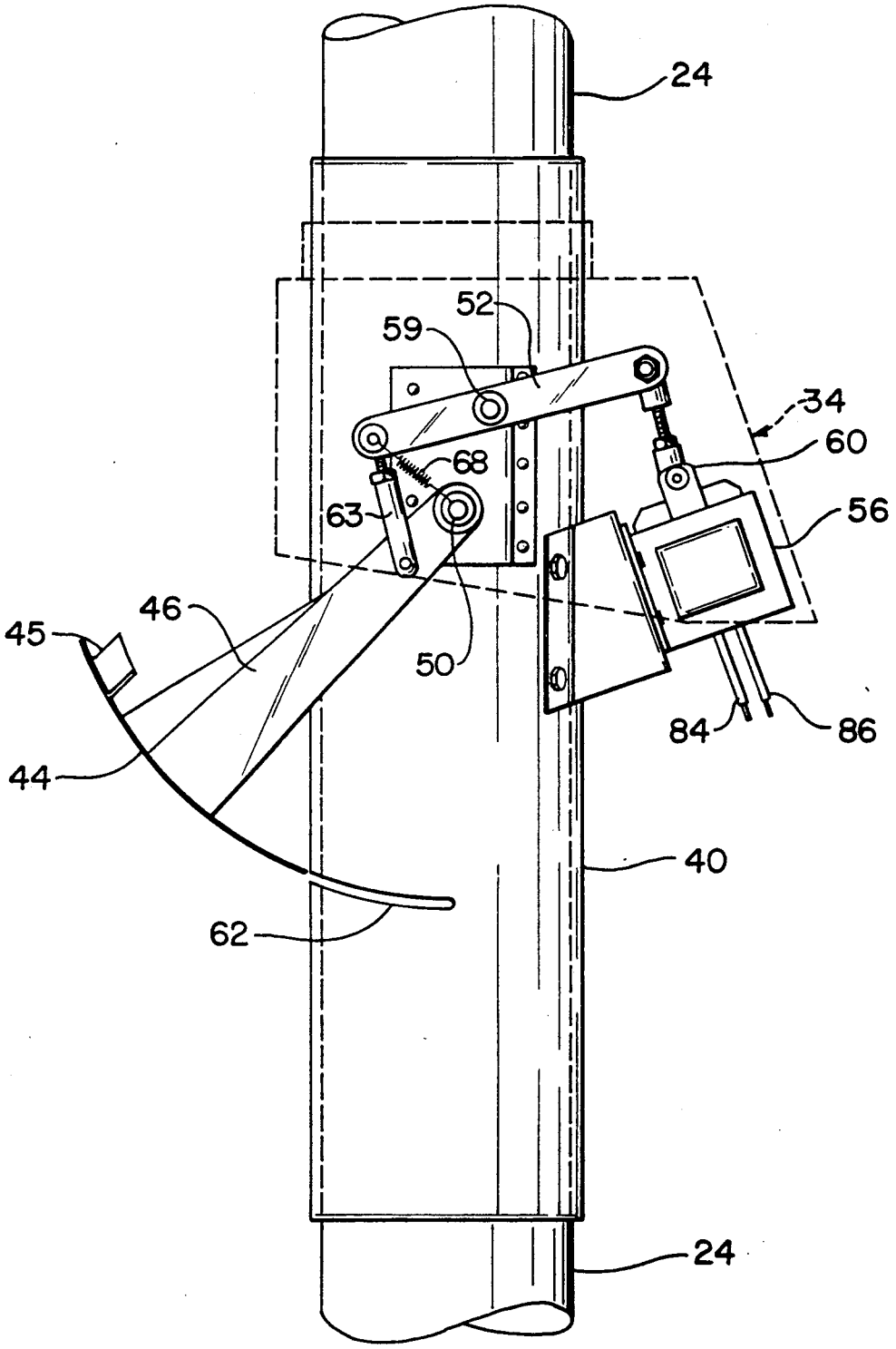
FIG. 2 is a side elevation of a valve assembly according to the invention, and in a first mode of operation.
Figure 3:
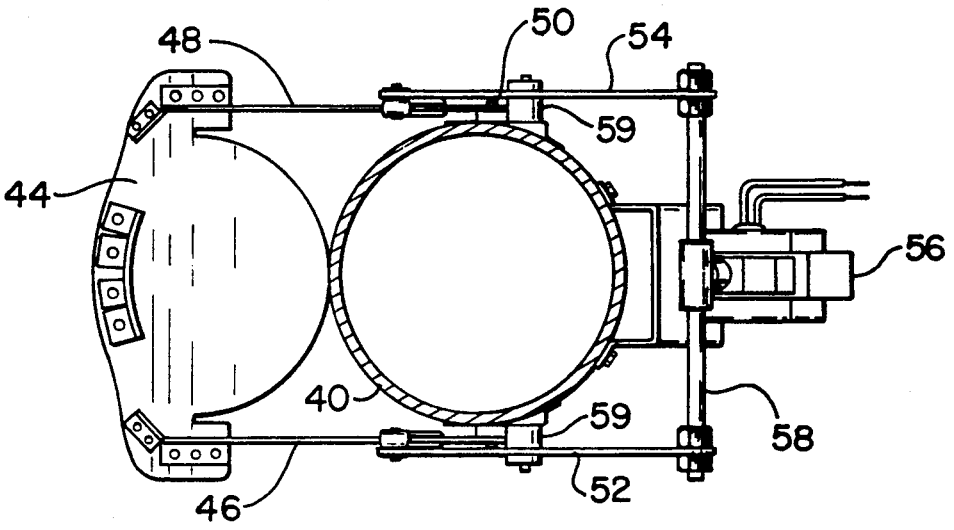
FIG. 3 is a top plan view.
Figure 4:
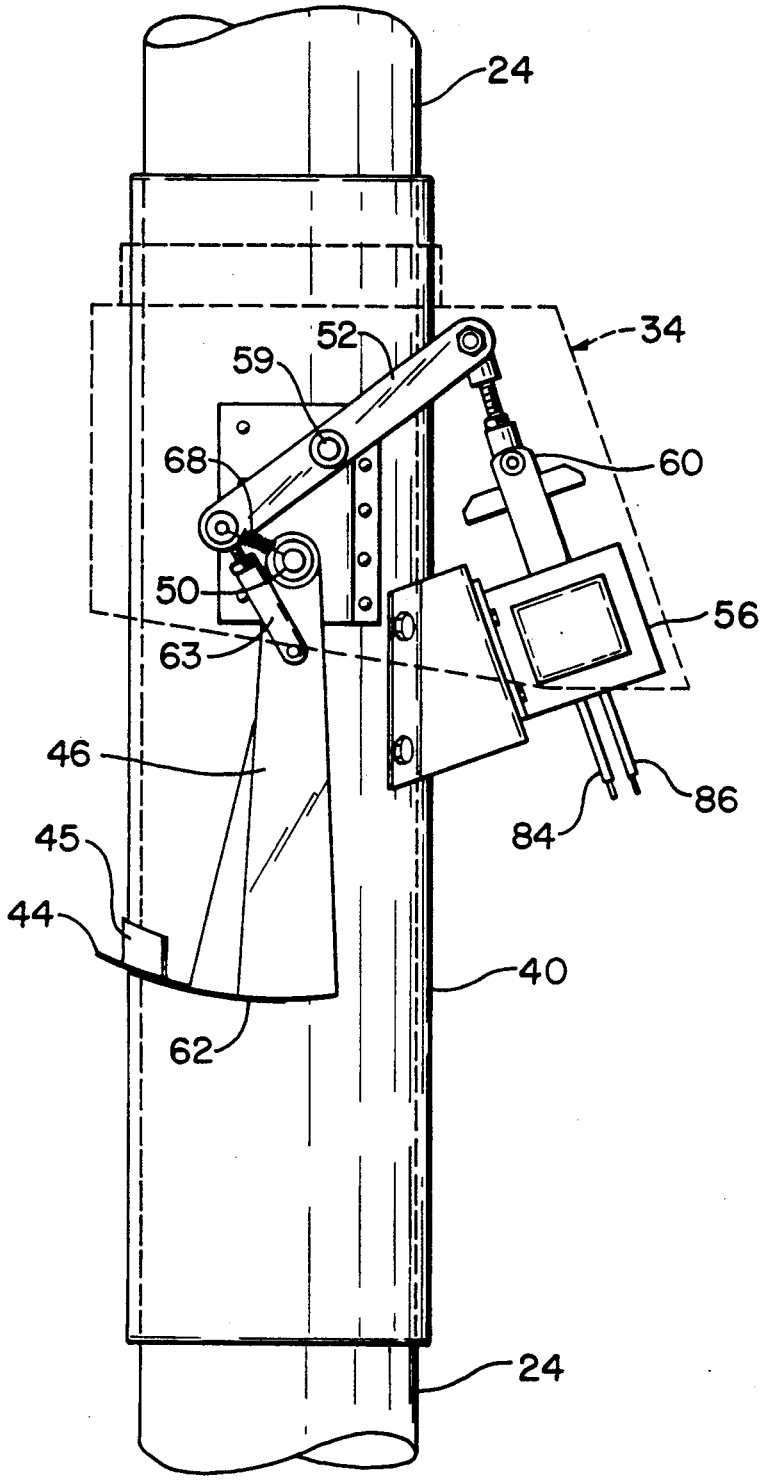
FIG. 4 is a side elevation similar to FIG. 2, and in a second mode of operation.
Figure 5:
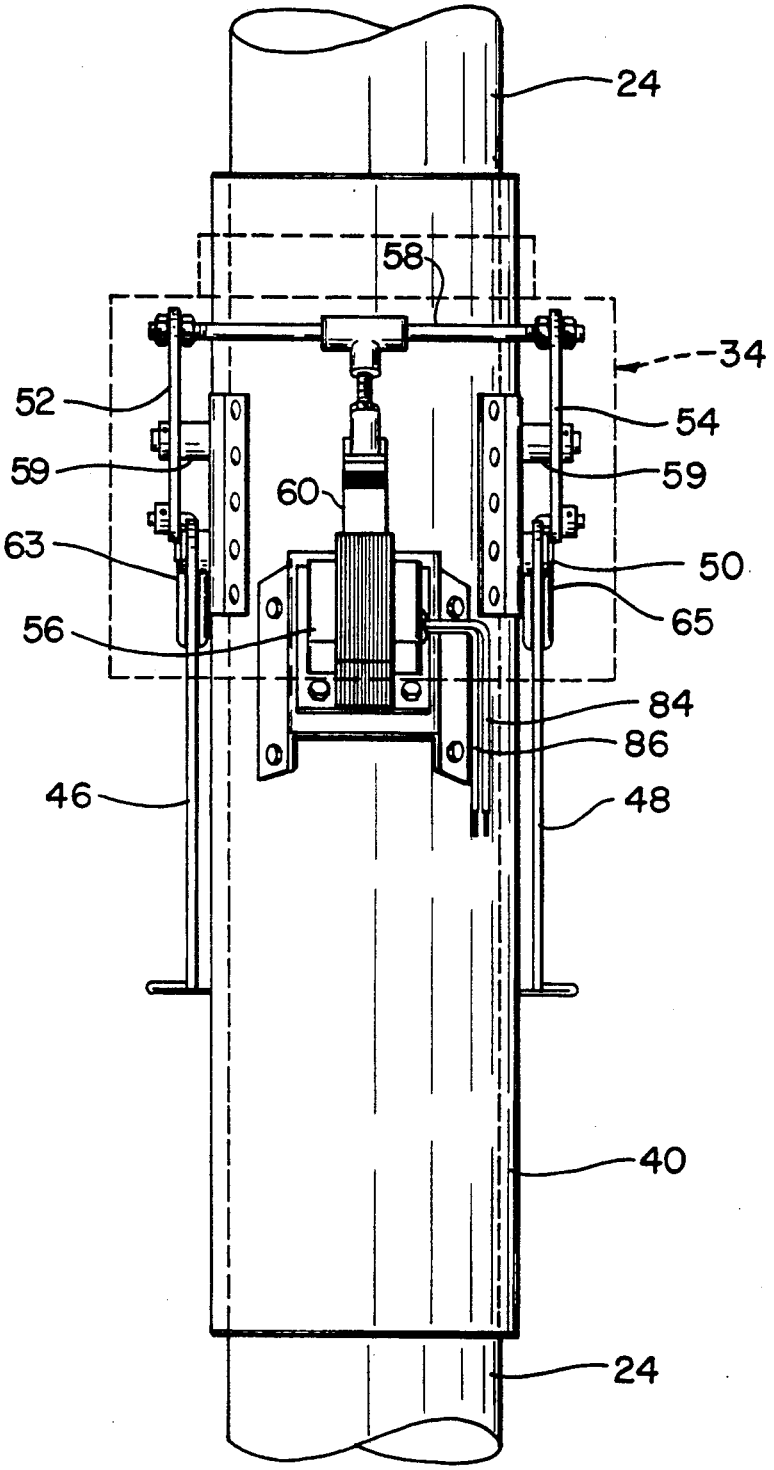
FIG. 5 is a front elevation of a valve assembly according to the invention, and in the second mode of operation.

The removal of controlling power to the solenoid 56 will permit extension of the plunger 60 from the open position of FIG. 2 to the closed position of FIG. 4, such that air flow through the valve housing 40 will be substantially prevented when the equipment is "off". A spring 68 or other biasing (not shown) can be provided such that, upon deactivation of the solenoid 56, the spring 68 will act to return the plunger 60 and the valve member 44 to the closed position of FIGS. 4–5, which will thereby prevent the waste of energy when the equipment is "off".

Figure 6:
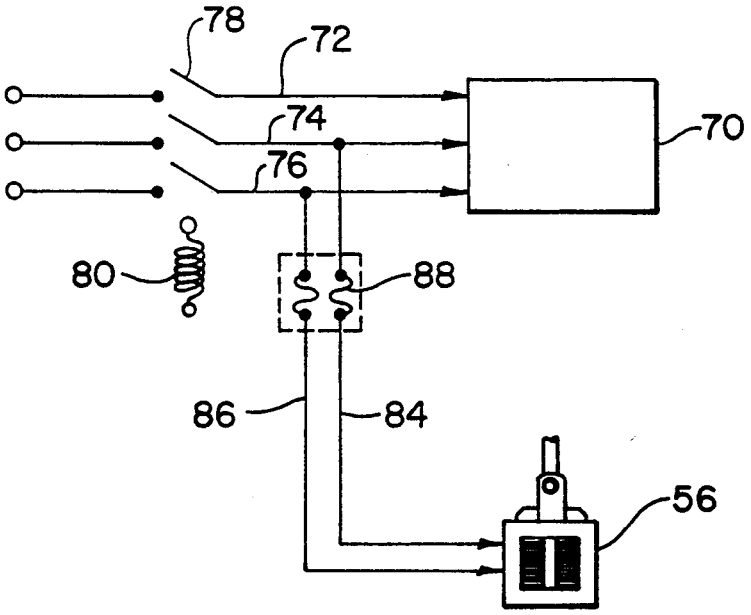
FIG. 6 is a schematic wiring diagram.

The manner in which the valve actuator is electrically connected to the equipment can be modified depending on the particular equipment that is being utilized and the particular valve actuator. One suitable wiring system is depicted in FIG. 6. In this system, equipment having a three-phase motor 70 is supplied with power by electrical power lines 72, 74, and 76. A three-pole, signal throw switch 78 can be electrically actuated as by the solenoid 80. Lines 84, 86, are respectively connected to the lines 74, 76 and are connected to the solenoid 56. Fuses 88 can be provided in the lines 84, 86 to prevent damage to the solenoid 80. Operation of the switch 78 will cause energy to be supplied through the lines 84, 86 to the solenoid 56. Conversely, when the switch 78 is open, power to the solenoid 56 will be shut off.

The invention is capable of taking several alternative forms. Alternative valve actuators can be provided in addition to the solenoid 56. One such alternative design would be an electric motor that is adapted to drive the valve member 44 to the closed position when the equipment is "off", and to drive the valve member 44 to the open position when the equipment is "on". Alternative designs to the valve member are possible as well. Further, alternate means for mounting and driving the valve member are also possible.

The invention is capable of being manufactured from several alternative materials, however, plastic materials such as polyvinylchloride have been found to be a preferable material for the non-electrical components. This material is durable, inexpensive, rust resistant, and does not create excessive vibration noise. The valve actuator, valve member, and other components can also be selected from equipment and materials that are known to be suitable for this purpose, including rust-resistant materials such as aluminum, plastic, or galvanized metals.

This invention can be embodied in other specific forms without departing from the spirit or essential attributes thereof, and accordingly, reference should be had to the following claims, rather than to the foregoing specification, as indicating the scope of the invention.

I claim:

1. A vacuum system for collecting gases and airborne particulates generated by equipment in a plurality of work areas, comprising:

a vacuum source having connected therewith a plurality of vacuum conduits, at least one of said conduits having a vacuum opening;

a gate valve with a gate valve member pivotally mounted by mounting means for pivot about an axis substantially transverse to said vacuum conduit, said gate valve member being insertable through a slot in said vacuum conduit to a "closed" position substantially blocking the flow of air through the conduit, and moveable to an "open" position substantially permitting the flow of air through the conduit;

a valve actuator solenoid and a lever arm operatively connecting said valve actuator solenoid to said gate valve member, said valve actuator solenoid and said lever arm being adapted to move the gate valve member to a position permitting the flow of air through the respective conduit whenever equipment associated with respective work areas is in a contaminant-generating mode of operation;

said equipment associated with the work area including a switch for placing the equipment in the contaminant-generating mode of operation, said valve actuator solenoid being electrically connected through said switch, movement of the switch to place equipment in the contaminant-generating mode of operation causing the valve actuator solenoid to effect movement of the gate valve member to the "open" position permitting the flow of air through the respective vacuum conduit, and movement of the switch so as to remove the equipment from the contaminate-generating mode of operation causing the return of the valve member to a "closed" position, blocking the flow of air; and, biasing means adapted to return the gate valve member to the "closed" position when electrical power to the valve actuator solenoid is shut off.

2. The system of claim 1, wherein said lever arm comprises at least one pivot arm pivotally connected to said vacuum conduit at a pivot point and to said gate valve member, said valve actuator solenoid being adapted to operatively act on said pivot arm nearer said pivot point than said gate valve member, whereby pivoting movement of the pivot arm by the valve actuator solenoid through a distance will cause movement of said gate valve member through a greater distance.

3. The system of claim 2, further comprising at least one intermediate pivot arm pivotally connected at a point between ends thereof to said vacuum conduit, said valve actuator solenoid acting upon a portion of said intermediate pivot arm to one side of said pivot point, a portion of said intermediate pivot arm on the other side of said pivot point being operatively connected to said gate valve pivot arm at a point closer to said pivot point of said gate valve pivot arm than to said gate valve member, whereby operation of said solenoid will cause pivoting of said intermediate pivot arm and said gate valve pivot arm, and thereby pivoting of said gate valve member.

4. The system of claim 1, wherein said biasing means is a spring.

* * * * *